United States Patent [19]

Stearns

[11] 4,438,965

[45] Mar. 27, 1984

[54] LOCKING DEVICE FOR VEHICLES EQUIPPED WITH SLIDING WINDOWS

[75] Inventor: Chris Stearns, Farmington, N. Mex.

[73] Assignee: C. K. Locks Limited, Farmington, N. Mex.

[21] Appl. No.: 309,582

[22] Filed: Oct. 8, 1981

[51] Int. Cl.[3] ..... E05C 19/18

[52] U.S. Cl. ..... 292/256.75

[58] Field of Search ..... 292/256.75, 258, 260, 292/259, 251, DIG. 46, 63; 49/336

[56] References Cited

U.S. PATENT DOCUMENTS

| | | | |
|---|---|---|---|
| 797,771 | 8/1905 | Heiser | 292/260 X |
| 1,546,192 | 7/1925 | Berg | 292/256.75 X |
| 2,775,001 | 12/1956 | Baker | 292/258 X |
| 4,089,551 | 5/1978 | Perreira | 292/246 X |

*Primary Examiner*—Richard E. Moore

*Attorney, Agent, or Firm*—Schwartz, Jeffery, Schwaab, Mack, Blumenthal & Koch

[57] ABSTRACT

The locking device includes a first arm which may be secured to a first sliding panel such as a window. A second arm is secured to a second sliding panel which may also be a window. Each arm is secured to a major surface of the respective panel and includes a laterally extending portion which abuts an edge of the panel. Each arm also includes a depending portion, which portions are connected by a bolt which is pivotally attached at one end to one of the portions. The opposite end of the bolt is slotted to receive the other depending portion. A nut threadably engages the bolt to hold the other depending portion within the slot.

8 Claims, 4 Drawing Figures

LOCKING DEVICE FOR VEHICLES EQUIPPED WITH SLIDING WINDOWS

BACKGROUND OF THE INVENTION

1. Field of the Invention

This invention relates to devices for securing moving panels and especially to such devices which are adapted to hold oppositely opening windows on a vehicle in a closed position.

2. Discussion of Related Art

The cabs of trucks are commonly built with windows in the rear to provide the driver with a clear field of vision. Often, these windows are made in the form of panels which slide to each side in order to provide an open area between the cab and the rear of the truck. This is often the case in pickup trucks where such an open area is desirable to allow communication between people in the cab and, for example, people in the bed of the truck which may have a camper or the like connected to it. It is desirable to tightly secure these windows so that entry into the cab cannot be had when the windows are closed. There is no adequate known locking device which can be readily attached to these windows to ensure that they will be maintained in a closed position.

Various locking devices for sliding windows and sliding doors have been suggested. However, these locking devices are useful only on panels which slide toward each other to open. They do not operate adequately for panels which slide away from each other to open.

U.S. Pat. No. 4,073,522 to Tierney shows a typical locking device for sliding doors. The Tierney device comprises a hinged unit formed from first and second bars which fit between an external bottom edge of a slidable door and the bottom side edge of the door frame.

U.S. Pat. No. 3,993,336 to Frost shows another device for use with sliding doors. The Frost device comprises a minor portion and major portion which can be disposed aligned with each other for holding the door completely closed or can be disposed in parallel relation for allowing a door to be partially opened.

U.S. Pat. No. 3,816,967 to Littrell shows a security bar for sliding doors which also fits between a door and an edge of the door frame. The Littrell device comprises a bar which is extendable in length in order to fit many different sizes and types of doors.

U.S. Pat. No. 3,825,290 to Messina et al shows a sliding door lock bar which includes a bar member having one end rigidly secured to a fixed member of the door frame and another end secured to a movable panel. Intermediate the ends there is provided a pivot for defining two hinged sections. An automatic locking device in the form of a plunger-like member is integral with one of the hinged sections and cooperates with a recess in the other hinged section so that the bar locks when the two hinged sections are aligned.

SUMMARY OF THE INVENTION

An object of the present invention is to provide a locking device for use on movable panels which open by moving away from each other.

A further object of the present invention is to provide a locking device for movable panels which can be quickly and easily installed on existing panels without having to remove the panels from their mounting.

A still further object of the present invention is to provide a locking device for movable panels which is relatively inexpensive yet durable and highly effective in use.

Yet another object of the present invention is to provide a locking device for movable panels which can be used within the cab of a truck without interfering with the movements of occupants of the truck.

In accordance with these and other objects, the present invention comprises a locking device for securing oppositely movable sliding panels, such as sliding windows in the cab of a truck, or the like. The device includes a first arm which can be attached to one of the panels, and a second arm which can be attached to a second of the panels. A bolt detachably connects the two arms. The bolt is pivotally mounted on one end to the first arm and contains a slot on the opposite end for receiving the second arm. A nut threadably engages the bolt for holding the second arm in the slot. The second arm includes a notched portion which engages the bolt within the slot so that the bolt cannot be pulled from the slot when the nut is tightened. Each arm is attached to a respective panel by being glued to one surface of the panel. Each arm also includes a laterally extending portion which engages an edge of the panel to which it is attached. Also, each arm contains a depending portion, which depending portions are connected to the bolt. The depending portions extend below the panels so that the bolt and nut are not visible through the panels.

The device of the present invention can be sold as a separate unit and attached to the panels or can be mounted with the panels when they are assembled. The size of the unit will vary relative to the size of the panels on which it is to be used.

BRIEF DESCRIPTION OF THE DRAWINGS

The above and other objects will become more readily apparent as the invention is more fully described hereinafter in the detailed description, reference being had to the accompanying drawings in which like reference numerals represent like parts throughout and in which.

DETAILED DESCRIPTION OF THE PREFERRED EMBODIMENT

Figure 1:
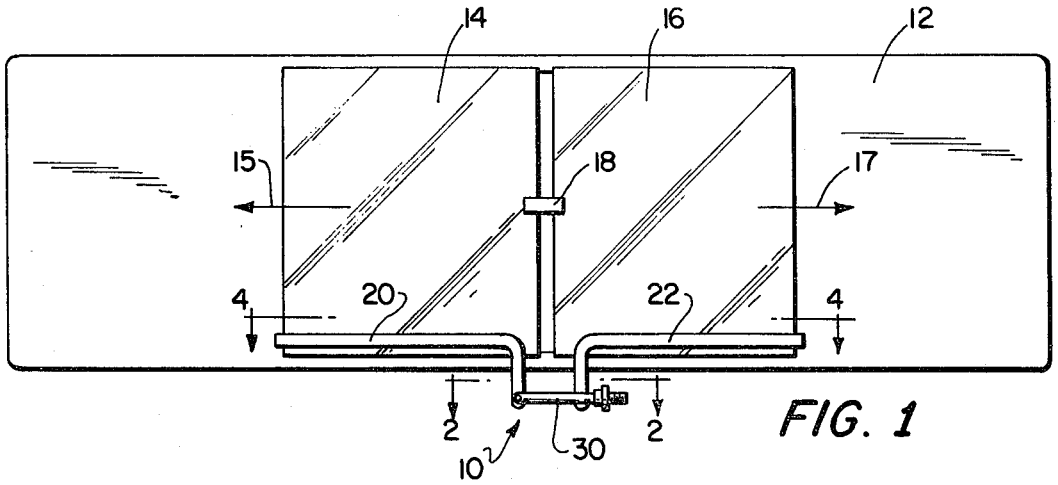
FIG. 1 shows a pair of sliding windows in the cab of a truck with the locking device of the present invention attached.

FIG. 1 is a view looking from the inside of a truck cab toward the cab rear wall 12. Sliding windows 14 and 16 are mounted to the rear wall and are connected by a simple latch mechanism 18. Windows 14 and 16 slide in opposite directions indicated by arrows 15 and 17 to open giving occupants of the cab an opening through which access may be gained to the rear of the truck.

Windows 14 and 16 form no part of the present invention and are mounted in a conventional manner to enable them to slide in the directions indicated by arrows 15 and 17. Details of the construction and mounting of these windows will not be entered into here.

When the windows are closed, as shown in FIG. 1, it is desirable to have a more secure mechanism than latch 18 for holding them in the closed position. Accordingly, locking device 10 is installed on the windows. Locking device 10 comprises a pair of arms 20 and 22 which are connected respectively to windows 14 and 16. Arms 20 and 22 can be connected together when the windows are closed by a connector bolt 30.

Figure 4:
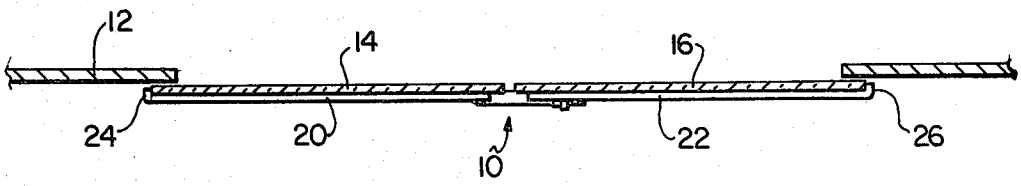
FIG. 4 is a top plan view taken along a plane passing through section line 4—4 of FIG. 1 showing the connection of the arms to the windows.

Each arm 20, 22 can be formed of any sturdy, rigid material such as steel, cast iron, or possibly a strong synthetic resin material such as fiberglass or the like. Arms 20 and 22 contain central portions which are elongated and may be connected to the windows by use of adhesive or the like. If desired, bolts could be passed through the arms and windows to secure the arms to the windows. However, the locking device 10 is designed to be mounted on sliding windows by persons who buy vehicles and wish additional security for them. Accordingly, it is sufficient to provide adhesive backings to each of the arms so that the arms can be easily glued to the windows. Many strong adhesive backings are known which can be used for this purpose. As shown in FIG. 4, each arm 20, 22 also includes a laterally extending portion 24, 26 respectively. Portions 24 and 26 extend rearwardly of the cab and engage the edges of windows 14 and 16, respectively. Accordingly, any attempt made to open windows 14 and 16 when the arms are interconnected meets with failure both because the arms are glued to the windows and because the attempted opening only forces the windows against portions 24 and 26 which will not allow movement of the windows.

Figure 3:
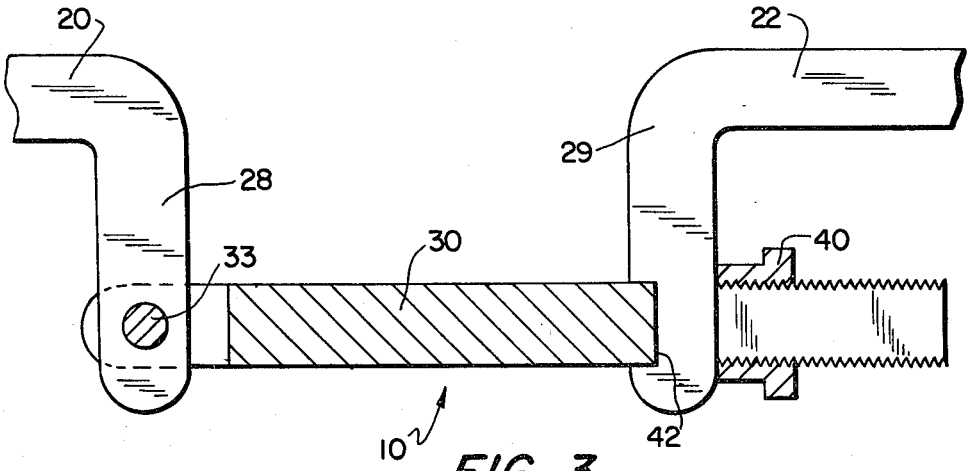
FIG. 3 is a longitudinal sectional view taken along a plane passing through line 3—3 of FIG. 2 showing the connection between the arms and the bolt of the locking device.

As seen in FIGS. 1 and 3, arms 20 and 22 include depending portions 28 and 29, respectively which extend below the level of windows 14 and 16. Connector bolt 30 is attached between the lower ends of depending portions 28 and 29. Accordingly, bolt 30 cannot easily be seen from outside of windows 14 and 16. Additionally, by disposing bolt 30 below the windows, the field of view of the occupants of the truck is less disrupted.

Figure 2:
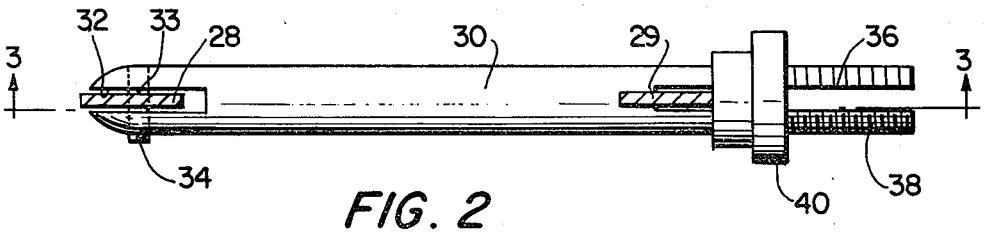
FIG. 2 is a top plan view taken along a plane passing through section line 2—2 showing the bolt of the locking device.

Bolt 30 is shown most clearly in FIGS. 2 and 3. Bolt 30 comprises a steel bolt having a slot 32 formed in its forward end to receive depending portion 28 of arm 20. Portion 28 is pivotally mounted within slot 32 by a pivot pin 33 which extends through aligned openings in pin 30 and portion 28. Pin 33 has screw threads 34 formed on one end to threadably engage cooperating threads within the opening formed in bolt 30. Clearly, other mechanisms for holding pin 33 within the bolt can be used.

An elongated slot 36 is formed in the opposite end of bolt 30 to receive depending portion 29. The portion of bolt 30 around slot 36 has threads 38 formed thereon for receiving threaded bolt 40. Bolt 40 can be a wing bolt or the like for manual operation. Portion 29 is inserted into slot 36 between nut 40 and the solid portion of bolt 30 so that nut 40 can be tightened onto the bolt to wedge portion 29 within the slot. Also, a notch 42 is formed on depending portion 29 to engage the solid part of bolt 30. In this manner, when nut 40 is tightened, notch 42 keeps bolt 30 engaged with portion 29 so that the bolt cannot be removed therefrom.

The operation of the locking device should be apparent from the above description. The device can be purchased as a separate unit and attached to windows 14 and 16 by an adhesive backing, as discussed. When initially attached to the windows, bolt 30 will dangle from depending portion 29 of arm 20 around pin 33. Windows 14 and 16 can be freely opened and closed at this time. When it is desired to secure the windows in a closed position, nut 40 is backed off on threads 38 and windows 14 and 16 are brought toward each other. When the windows are almost closed but still separated by a slight distance, bolt 30 is swung upwardly so that portion 29 slides into slot 36 between nut 40 and the solid part of bolt 30. Notch 42 is aligned with the solid portion of bolt 30 and nut 40 is then tightened until the solid part of bolt 30 is firmly held within notch 42. In this position, bolt 30 cannot be removed from arm 22 until nut 40 is loosened and windows 14 and 16 cannot be opened.

Obviously, the dimensions of arms 20 and 22 are important in ensuring that the arms engage. For this reason, the size of the locking device must be chosen according to the dimensions of the windows on which it is to be used. However, it should be noted that for windows which do not vary greatly in size, arms 20 and 22 can be used and it is merely necessary to provide several bolts similar to 30 but having slots 36 which vary in depth so that the solid part of the bolts varies in length to accommodate the different sized windows. In this manner, various window sizes can be accommodated without greatly increasing the cost of production of the device.

The foregoing is considered to be illustrative of the invention but not limitative. Obviously, numerous modifications, additions and changes can be made to the invention without departing from the scope thereof as set forth in the appended claims.

What is claimed is:

1. A locking device for securing oppositely movable sliding panels, comprising:

a first arm attachable to a first one of said panels;

a second arm attachable to a second one of said panels;

a bolt detachably connectable between said first and second arms, said bolt having a pivot joint connected to said first arm and a slot for receiving said second arm; and a nut threadably engaging said bolt and extending across said slot for holding said second arm in said slot, wherein said second arm includes a notched portion engaging said bolt within said slot.

2. The device as set forth in claim 1, wherein each of said first and second arms includes a laterally extending portion for engaging an edge of said first and second panels, respectively.

3. The device as set forth in claim 1, wherein each of said first and second arms includes a depending portion, said pivot joint being connected to the depending portion of said first arm and said notch being formed in the depending portion of said second arm.

4. The device as set forth in claim 1, wherein said pivot joint comprises a second slot formed in said bolt, said first arm being disposed in said second slot and a pivot pin extending through said bolt and said first arm.

5. In combination, a pair of sliding windows which move oppositely from each other to open, and a locking device for locking said windows in a closed position, said locking device comprising:

a first arm fixedly attached to said first window;

a second arm fixedly attached to said second window;

a bolt detachably connectable between said first and second arms, said bolt having a pivot joint connected to said first arm and a slot for receiving said second arm; and a nut threadably engaging said bolt and extending across said slot for holding said second arm in said slot.

6. The combination as set forth in claim 5, wherein said second arm includes a notched portion engaging said bolt within said slot.

7. The device as set forth in claim 5, wherein each of said first and second arms includes a laterally extending portion engaging an edge of said first and second panels, respectively.

8. The device as set forth in claim 5, wherein each of said first and second arms includes a depending portion extending to free ends disposed below said windows, said pivot joint being connected to the free end of said depending portion of said first arm, and said notch being formed in the free end of said depending portion of said second arm.

* * * * *